US009812062B2

(12) United States Patent
Kang et al.

(10) Patent No.: US 9,812,062 B2
(45) Date of Patent: Nov. 7, 2017

(54) DISPLAY APPARATUS AND METHOD OF DRIVING THE SAME

(71) Applicant: SAMSUNG DISPLAY CO., LTD., Yongin, Gyeonggi-Do (KR)

(72) Inventors: Hyungryul Kang, Yongin (KR); Cheolmin Kim, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 14 days.

(21) Appl. No.: 14/735,484

(22) Filed: Jun. 10, 2015

(65) Prior Publication Data

US 2016/0133191 A1 May 12, 2016

(30) Foreign Application Priority Data

Nov. 12, 2014 (KR) ..... 10-2014-0157334

(51) Int. Cl.
*G09G 3/32* (2016.01)
*G09G 3/3258* (2016.01)

(52) U.S. Cl.
CPC ..... *G09G 3/3258* (2013.01); *G09G 2300/043* (2013.01); *G09G 2300/0871* (2013.01); *G09G 2300/0876* (2013.01); *G09G 2310/0216* (2013.01); *G09G 2320/045* (2013.01)

(58) Field of Classification Search
CPC ..... G09G 3/3258; G09G 3/3233; G09G 2300/043; G09G 3/3241; G09G 3/325
See application file for complete search history.

(56) References Cited

U.S. PATENT DOCUMENTS 9,330,596 B2 * 5/2016 Choi ..... G09G 3/3233
2010/0309187 A1 * 12/2010 Kang ..... G09G 3/3233 345/211
2011/0157125 A1 * 6/2011 Choi ..... H05B 33/0896 345/211
2012/0001893 A1 1/2012 Jeong et al.
2012/0147060 A1 6/2012 Jeong
2013/0335456 A1 12/2013 Matsui et al.

FOREIGN PATENT DOCUMENTS

KR 10-2012-0002070 1/2012
KR 10-2012-0065137 6/2012
KR 10-2013-0119324 10/2013
KR 10-2014-0087269 A 7/2014

* cited by examiner

*Primary Examiner* — Jennifer Mehmood
*Assistant Examiner* — Sardis F Azongha
(74) *Attorney, Agent, or Firm* — Lee & Morse, P.C.

(57) ABSTRACT

A display apparatus includes pixels connected to scan lines, data lines, and emission control lines. Each include includes an organic light-emitting diode (OLED), a first transistor to transfer driving current to the OLED based on a data signal, a second transistor to transfer the data signal to the first transistor based on a first scan signal having a gate-on voltage level during a data writing period, a first capacitor connected between a gate electrode of the first transistor and a first power source, and a second capacitor connected between a drain electrode of the first transistor and the first power source.

17 Claims, 6 Drawing Sheets

DISPLAY APPARATUS AND METHOD OF DRIVING THE SAME

CROSS-REFERENCE TO RELATED APPLICATION

Korean Patent Application No. 10-2014-0157334, filed on Nov. 12, 2014, and entitled: "Display Apparatus and Method Of Driving The Same," is incorporated by reference herein in its entirety.

BACKGROUND

1. Field

One or more embodiments described herein relate to a display apparatus and method for driving a display apparatus.

2. Description of the Related Art

A variety of flat panel displays have been developed. Examples include a liquid crystal display and an organic light-emitting display. An organic light-emitting display generates images using an organic light-emitting diode that emits light based on a recombination of an electrons and holes. In such a display, pixels are arranged in a matrix at intersection points of scan lines and data lines. The aforementioned displays are suitable for miniaturization in variety of electronic products of various sizes, e.g., from small easy-to-carry devices to large-size and high-resolution screens.

SUMMARY

In accordance with one or more embodiment, a display apparatus includes a display unit including a plurality of pixels connected to a plurality of scan lines, a plurality of data lines, and a plurality of emission control lines, wherein each of the pixels includes: an organic light-emitting diode (OLED); a first transistor to transfer driving current, based on a data signal, to the OLED; a second transistor to transfer the data signal to the first transistor based on a first scan signal having a gate-on voltage level during a data writing period; a first capacitor connected between a gate electrode of the first transistor and a first power source; and a second capacitor connected between a drain electrode of the first transistor and the first power source.

The gate electrode of the first transistor may be connected to a first node, and the first node may connect the first transistor to the second transistor. Each of the pixels may include a third transistor to supply an initialization voltage to the gate electrode of the first transistor, in order to initialize a characteristic of the first transistor based on a second scan signal having the gate-on voltage level during an initialization period.

The second scan signal may have the gate-on voltage level during a unit scan period immediately before the data writing period. The second scan signal may have the gate-on voltage level during one or more unit scan periods before the data writing period. The first scan signal may have the gate-on voltage level during a unit scan period before a unit scan period in which the second scan signal has the gate-on voltage level.

The second scan signal may have the gate-on voltage level during two or more unit scan periods before the data writing period, and the first scan signal may have the gate-on voltage level during a unit scan period between two or more unit scan periods in which the second scan signal has the gate-on voltage level.

The second scan signal may have the gate-on voltage level during two or more unit scan periods before the data writing period, and a period between two or more unit scan periods in which the second scan signal may have the gate-on voltage level is multiples of a unit scan period. The first scan signal may have the gate-on voltage level during one or more unit scan periods before the data writing period, and the second scan signal may have the gate-on voltage level during a unit scan period immediately before a unit scan period in which the first scan signal has the gate-on voltage level before the data writing period and/or a unit scan period immediately after a unit scan period in which the first scan signal has the gate-on voltage level. The initialization period may be prior to the data writing period.

Each of the pixels may include a fourth transistor that diode-connects the first transistor based on the first scan signal having the gate-on voltage level during the data writing period. Each of the pixels may include a fifth transistor to supply the initialization voltage to an anode electrode of the OLED based on a third scan signal. The third scan signal may be equal to the first scan signal.

Each of the pixels may include sixth transistor to turn on based on a emission control signal, the sixth transistor connected to the second capacitor in parallel. Each of the pixels may include a seventh transistor to connect the first transistor to the OLED based on an emission control signal.

The display apparatus may include a scan driver to transfer scan signals through the scan lines; a data driver to transfer data signals through the data lines; and an emission driver to transfer emission control signals through the emission control lines.

In accordance with one or more other embodiments, a method for driving a display apparatus includes initializing a characteristic of the driving transistor; compensating for a threshold voltage of the driving transistor and transferring a data signal to the driving transistor; and emitting light from the OLED based on driving current corresponding to the data signal, wherein initializing the characteristic includes: transferring a first scan signal having a gate-on voltage level at least one time; and transferring a second scan signal having the gate-on voltage level at least one time.

The first scan signal may have the gate-on voltage level during a unit scan period before a unit scan period in which the second scan signal has the gate-on voltage level. The first scan signal may have the gate-on voltage level during a unit scan period between two or more unit scan periods in which the second scan signal has the gate-on voltage level. The second scan signal may have the gate-on voltage level during two or more unit scan periods, and a period between two or more unit scan periods in which the second scan signal has the gate-on voltage level may be multiples of a unit scan period.

In accordance with one or more other embodiments, an apparatus includes one or more outputs and a controller to output one or more signals through the one or more outputs to control a display, wherein the one or more signals are to initialize a characteristic of the driving transistor of a pixel, compensate a threshold voltage of the driving transistor, transfer a data signal to the driving transistor, and control emission of light from the pixel based on driving current corresponding to the data signal, and wherein the controller is to initialize the characteristic of the driving transistor by transferring a first scan signal having a gate-on voltage level at least one time and transferring a second scan signal having the gate-on voltage level at least one time.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
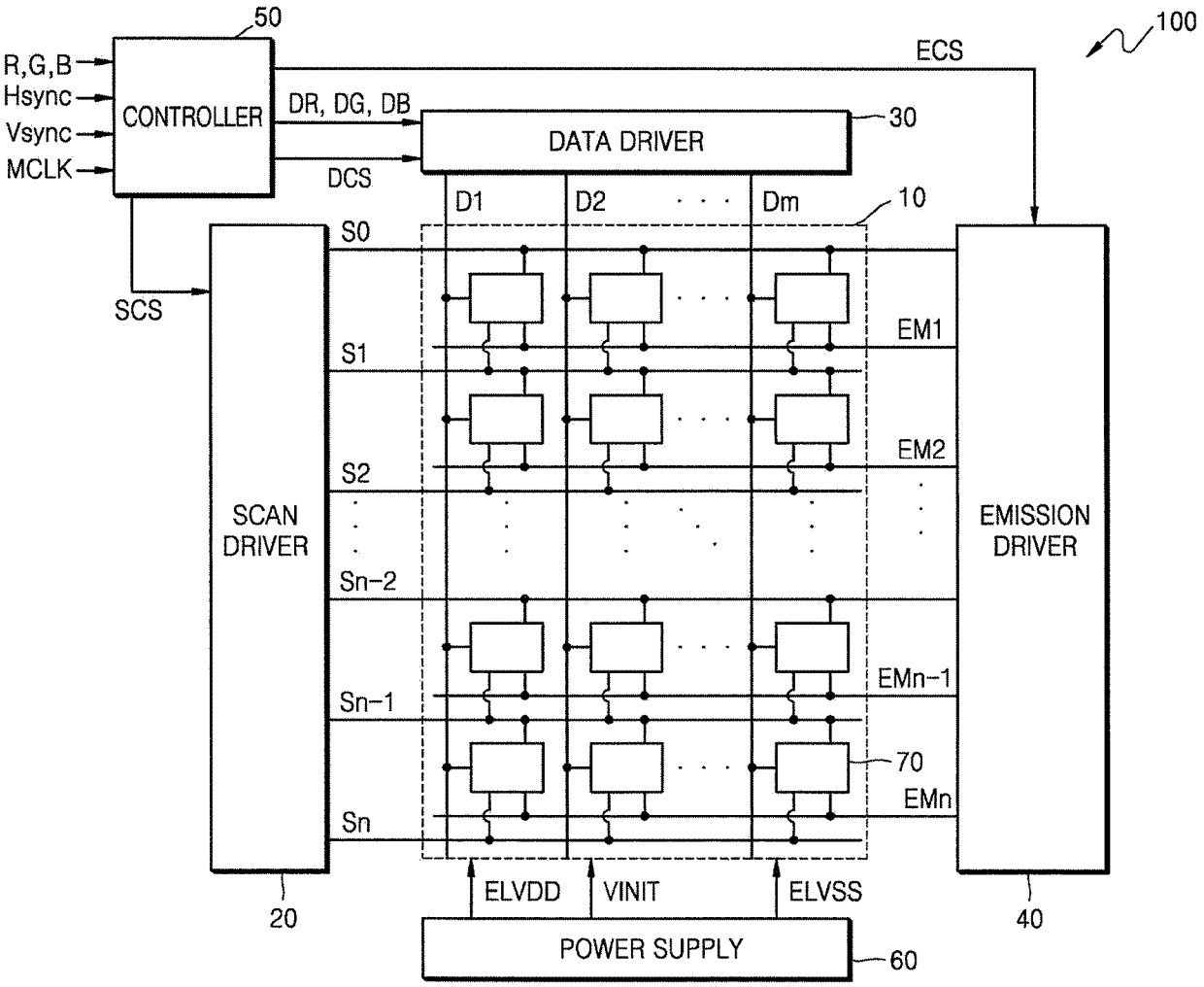
FIG. 1 illustrates an embodiment of a display apparatus.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

FIG. 1 illustrates an embodiment of a display apparatus 100 which includes a display unit 10 having a plurality of pixels, a scan driver 20, a data driver 30, an emission driver 40, a controller 50, and a power supply 60 that supplies an external voltage to the display unit 10. The pixels are connected to scan lines S0 to Sn. For example, each pixel 70 may be connected to two scan lines, a corresponding scan line and a previous scan line. Each pixel is connected to one of data lines D1 to Dm and one of emission control lines EM1 to EMn.

The scan driver 20 generates one or more scan signals and transfers the scan signals to each pixel through the scan lines S0 to Sn. For example, the scan driver 20 transfers a first scan signal through the corresponding scan line and transfers a second scan signal through the previous scan line.

Put another way, the pixel 70 in an nth pixel line may be connected to an nth scan line Sn corresponding to the nth pixel line and an n−1st scan line Sn−1 corresponding to an n−1st pixel line previous to the nth pixel line. The pixel 70 receives the first scan signal through the nth scan line Sn and receives the second scan signal through the n−1st scan line Sn−1.

The data driver 30 respectively transfers data signals to the pixels through the data lines D1 to Dm. The emission driver 40 transfers an emission control signal to the pixels through the emission control lines EM1 to EMn.

The controller 50 converts a plurality of image signals R, G and B, transferred from an image signal source, to a plurality of image data signals DR, DG and DB and transfers the image data signals DR, DG and DB to the data driver 30. Also, the controller 50 receives a vertical sync signal Vsync, a horizontal sync signal Hsync, and a clock signal MCLK to generate control signals for controlling driving of the scan driver 20, the data driver 30, and the emission driver 40. In one embodiment, the controller 50 generates a scan driving control signal SCS for controlling the scan driver 20, a data driving control signal DCS for controlling the data driver 30, and an emission driving control signal ECS for controlling the emission driver 40.

In the display unit 10, the pixels are disposed at intersections of the scan lines S0 to Sn, data lines D1 to Dm, and emission control lines EM1 to EMn. The pixels are supplied with external voltages, such as a first source voltage ELVDD, a second source voltage ELVSS, and an initialization voltage VINIT, from the power supply 60. The first source voltage ELVDD is greater than the second source voltage ELVSS.

In the display unit 10, the pixels are arranged in a matrix type. The scan lines S0 to Sn extend in a row direction in an arrangement type of the pixels and are parallel with each other. The data lines D1 to Dm extend in a column direction and are parallel with each other. Each pixel emits light with a driving current which is supplied to an organic light-emitting diode according to a data signal transferred through the plurality of data lines D1 to Dm.

Figure 2:
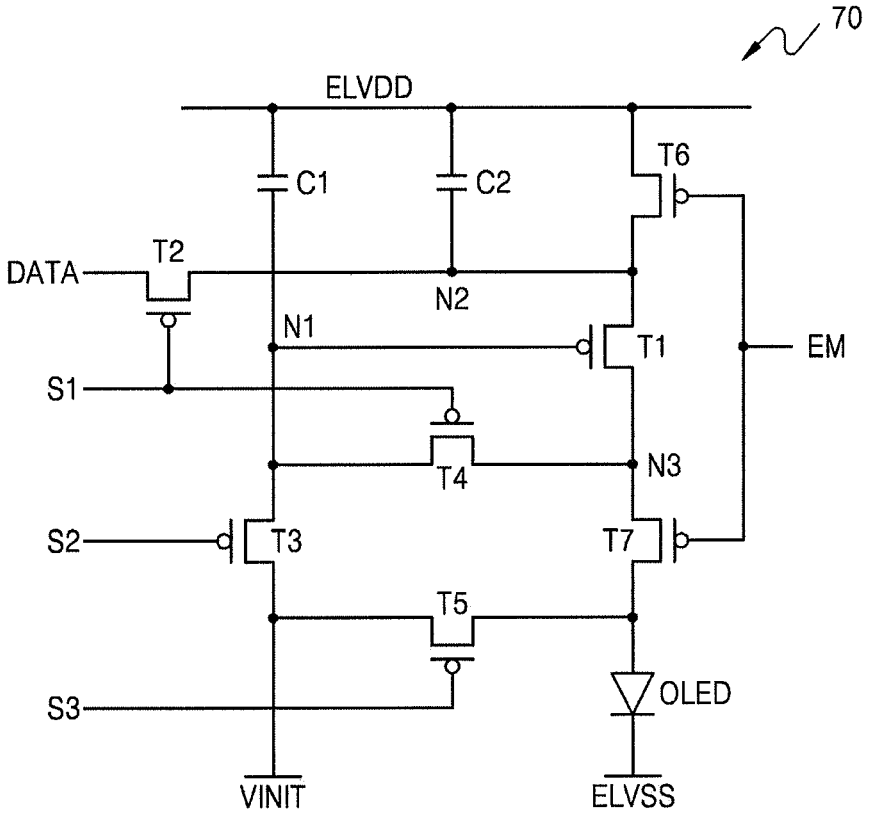
FIG. 2 illustrates an embodiment of a pixel circuit.

FIG. 2 illustrates an embodiment of a pixel circuit 70, which is connected to a plurality of scan lines through which a plurality of scan signals are respectively transferred. For example, the pixel 70 is connected to a first scan line S1 which transfers a first scan signal having a gate-on voltage level during a data writing period, a second scan line S2 which transfers a second scan signal having the gate-on voltage level during an initialization period, and a third scan line S3 which transfers a third scan signal having the gate-on voltage level during the data writing period.

The first scan line S1 transfers the first scan signal for transferring a data signal to a first transistor T1 during the data writing period. The second scan line S2 transfers the second scan signal for supplying the initialization voltage to a gate electrode of the first transistor T1 to initialize a characteristic of the first transistor T1 during the initialization period. The third scan line S3 transfers the third scan signal for supplying the initialization voltage to an anode electrode of an organic light-emitting diode OLED. The pixel 70 is connected to a data line DATA and an emission control line EM.

In one exemplary embodiment, the pixel 70 includes an organic light-emitting diode, a plurality of transistors, and a plurality of capacitors. For example, the pixel 70 includes the organic light-emitting diode OLED, the first transistor T1 connected to the anode electrode of the organic light-emitting diode OLED, a second transistor T2 connected to a drain electrode of the first transistor T1, a first capacitor C1 connected between a first node N1 connected to the gate electrode of the first transistor T1 and a first power source ELVDD supplying the first source voltage, and a second capacitor C2 connected between a second node N2 connected to the drain electrode of the first transistor T1 and the first power source ELVDD supplying the first source voltage.

The organic light-emitting diode OLED includes the anode electrode and a cathode electrode, and emits light according to a driving current based on a data signal. The driving current may be compensated so as not to be affected by deterioration or variation in a threshold voltage of a driving transistor of the pixel 70.

The first transistor T1 includes the drain electrode connected to the second node N2, a source electrode connected to a third node N3, and the gate electrode connected to the first node N1. The first transistor T1 receives a data signal through the second transistor T2 connected to the second node N2.

The first transistor T1 transfers driving current based on the data signal to the organic light-emitting diode OLED. The driving current may correspond to a voltage difference between the source electrode and gate electrode of the first transistor T1. The first transistor T1 serves as the driving transistor of the pixel 70. The first transistor T1 also includes a source electrode connected to the second node N2, and a drain electrode connected to a third node N3. In another embodiment, the source and drain electrodes may be exchanged.

The second transistor T2 includes a drain electrode connected to the data line DATA to receive a data signal, a source electrode connected to the second node N2, and a gate electrode connected to the first scan line S1 to receive the first scan signal. When the second transistor T2 is turned on by the first scan signal transferred through the first scan line S1, the data signal is transferred to the second node N2 and a data voltage "VDATA" corresponding to the data signal is applied to the drain electrode of the first transistor T1. The first scan signal may be simultaneously applied to a gate electrode of a threshold voltage compensation transistor.

The pixel 70 may include a third transistor T3 connected between the first node N1 and an initialization power source VINIT supplying the initialization voltage. The transistor T3 includes a gate electrode connected to the second scan line S2, a drain electrode connected to the initialization voltage, and a source electrode connected to the gate electrode of the first transistor T1. The third transistor T3 transfers the initialization voltage to the gate electrode of the first transistor T1, and is turned on by the second scan signal.

During the initialization period, the third transistor T3 supplies the initialization voltage to the gate electrode of the first transistor T1 to initialize a characteristic of the first transistor T1 based on the second scan signal having the gate-on voltage level.

The initialization period may be before the data writing period. The initialization period may correspond to a period for initializing the characteristic of the first transistor T1. During the initialization period, the scan driver 20 may transfer each of the first scan signal and the second scan signal to the first transistor T1 at least one or more times.

For example, the second scan signal may have the gate-on voltage level during a unit scan period immediately before the data writing period. In another example, the second scan signal may have the gate-on voltage level during one or more unit scan periods before the data writing period. In another example, the first scan signal may have the gate-on voltage level during a unit scan period before a unit scan period in which the second scan signal has the gate-on voltage level.

In another example, the second scan signal may have the gate-on voltage level during two or more unit scan periods before the data writing period. At this time, the first scan signal may have the gate-on voltage level during a unit scan period between two or more unit scan periods in which the second scan signal has the gate-on voltage level. Alternatively, a period between the at least two or more unit scan periods in which the second scan signal has the gate-on voltage level may be multiples of the unit scan period.

In another example, the first scan signal may have the gate-on voltage level during one or more unit scan periods before the data writing period. The second scan signal may have the gate-on voltage level during a unit scan period immediately before a unit scan period in which the first scan signal has the gate-on voltage level before the data writing period and/or a unit scan period immediately after a unit scan period in which the first scan signal has the gate-on voltage level.

While each of the first and second scan signals has the gate-on voltage level during one or more unit scan periods, the initialization voltage is applied to the gate electrode of the first transistor T1.

While each of the first and second scan signals has the gate-on voltage level during one or more unit scan periods, the first source voltage is applied to the drain electrode of the first transistor T1 and the initialization voltage is applied to the gate electrode of the first transistor T1. Therefore, during the initialization period, a gate-source voltage of the first transistor T1 is a difference between the first source voltage and the initialization voltage and has a voltage value of the gate-source voltage of the first transistor T1 equal to or higher than a reference voltage with which the first transistor T1 operates.

Since the gate-source voltage of the first transistor T1 is equal to or higher than the reference voltage during the initialization period, the first transistor T1 is in an on bias state. When the driving transistor of each pixel is in an on-bias state, the data voltage "VDATA" is written in the driving transistor. Thus, hysteresis characteristics may be improved.

A data voltage of a previous frame is applied to each of a plurality of driving transistors. Thus, gate-source voltages of the driving transistors may have different levels before a data voltage of a current frame is written. In an exemplary embodiment, gate-source voltages of all the driving transistors become equal to the difference between the first source voltage and the initialization voltage during the initialization period, and all the driving transistors are on-biased under the same condition. Therefore, independently from hysteresis characteristic, the gate-source voltages of the driving transistors of all the pixels 70 may be determined based on a data voltage of a current frame under the same condition.

The pixel 70 may further include a fourth transistor T4 connected between the first node N1 and the third node N3. The fourth transistor T4 may diode-connect the first transistor T1 based on the first scan signal which has the gate-on voltage level during the data writing period. The fourth transistor T4 may serve as a threshold voltage compensation transistor that diode-connects the first transistor T1 to compensate for a threshold voltage "VTH" of the first transistor T1.

The fourth transistor T4 is connected between the gate electrode and source electrode of the first transistor T1. The fourth transistor T4 is turned on based on the first scan signal having the gate-on voltage level and diode-connects the first transistor T1. A voltage "VDATA-VTH," which is obtained by dropping the data voltage "VDATA" applied to the drain electrode of the first transistor T1 by the threshold voltage "VTH" of the first transistor T1, is applied to the gate electrode of the first transistor T1. Since the gate electrode of the first transistor T1 is connected to one end of the first capacitor C1, the voltage "VDATA-VTH" is held by the first capacitor C1. The voltage "VDATA-VTH," in which the threshold voltage "VTH" of the first transistor T1 is reflected, is applied to and maintained at the gate electrode. Thus, the driving current flowing in the first transistor T1 is not affected by the threshold voltage "VTH" of first transistor T1.

Since the first capacitor C1 is connected to the first node N1 connected to the gate electrode of the first transistor T1, the first capacitor C1 stores a voltage value at the gate electrode of the first transistor T1 according to driving of the pixel 70.

Since the second capacitor C2 is connected to the second node N2 connected to the drain electrode of the first transistor T1, the second capacitor C2 stores a voltage value at the drain electrode of the first transistor T1 according to driving of the pixel 70. Since the second capacitor C2 is connected between the drain electrode of the first transistor T1 and the first power source ELVDD supplying the first source voltage, a voltage at the drain electrode of the first transistor T1 is maintained during the initialization period. Thus, the first transistor T1 maintains an on-bias state.

The pixel 70 may include a fifth transistor T5 connected between the anode electrode of the organic light-emitting diode OLED and the initialization power source VINIT supplying the initialization voltage. The fifth transistor T5 may supply the initialization voltage to the anode electrode of the organic light-emitting diode OLED based on the third scan signal. The third scan signal may be the same signal as the first scan signal.

The pixel 70 includes one or more emission control transistors connected to the anode electrode of the organic light-emitting diode OLED and adjust emission of light based on the driving current of the organic light-emitting diode OLED. For example, the pixel 70 may include a sixth transistor T6 connected between the first transistor T1 and the first power source ELVDD supplying the first source voltage, and a seventh transistor T7 connected between the anode electrode of the organic light-emitting diode OLED and the first transistor T1.

The sixth transistor T6 is turned on in response to the emission control line EM, and is connected to the second capacitor C2 in parallel. The sixth transistor T6 includes a gate electrode connected to the emission control line EM, a drain electrode connected to the first power source ELVDD, and a source electrode connected to the second node N2.

The seventh transistor T7 may connect the first transistor T1 to the organic light-emitting diode OLED based on the emission control signal. The seventh transistor T7 includes a gate electrode connected to the emission control line EM, a drain electrode connected to the third node N3, and a source electrode connected to the anode electrode of the organic light-emitting diode OLED.

When the emission control signal having the gate-on voltage level is transferred, the sixth transistor T6 and the seventh transistor T7 are turned on. Also, a driving current corresponding to the data voltage "VDATA," which is stored in the first capacitor C1 during the data writing period, is transferred to the organic light-emitting diode OLED, thereby emitting light from the organic light-emitting diode OLED. The data voltage "VDATA" stored in the first capacitor C1 is a voltage value "VDATA-VTH" which takes into consideration the threshold voltage "VTH." Thus, when the organic light-emitting diode OLED receives the driving current to emit light, an effect of the threshold voltage "VTH" may not be excluded.

Pixels 70 are illustrated to include PMOS transistors. In another embodiment, the pixel 70 may include NMOS transistors.

Figure 3:
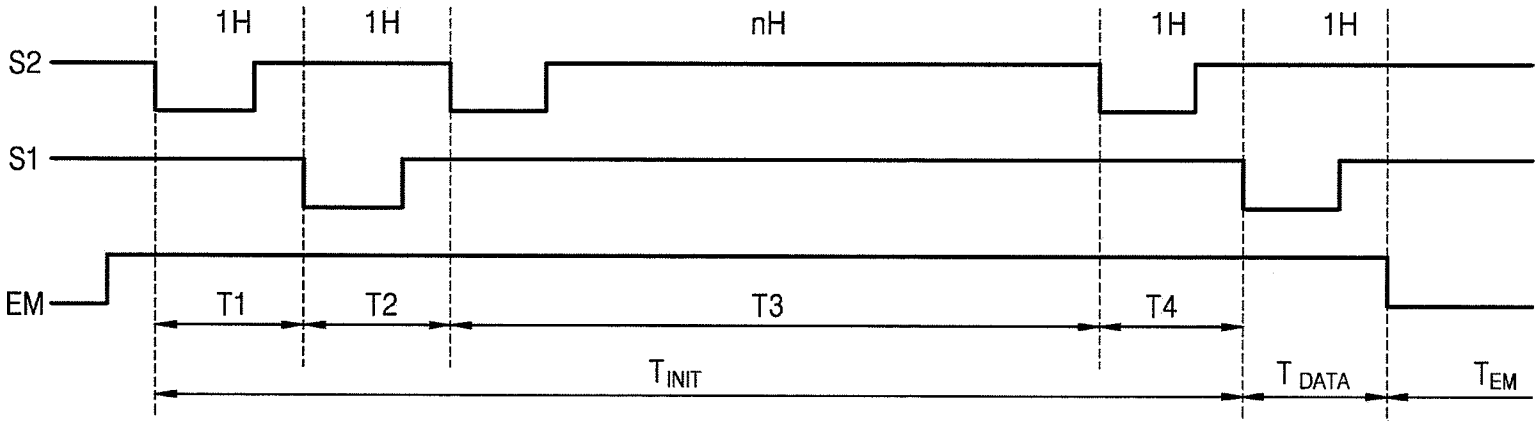
FIG. 3 illustrates an embodiment of control signals for driving the pixel circuit.

FIG. 3 is a timing diagram illustrating an embodiment of a driving operation of the pixel circuit 70, which is connected to scan lines for receiving scan signals. The timing diagram of FIG. 3 is for driving the pixel circuit 70 in the illustrative case where the transistors are PMOS transistors.

During an initialization period $T_{INIT}$, the pixel 70 receives each of the first and second scan signals S1 and S2 having the gate-on voltage level at least one or more times. In one exemplary embodiment, the second scan signal S2 may have the gate-on voltage level during one or more unit scan periods before a data writing period $T_{DATA}$. For example, the second scan signal S2 may have the gate-on voltage level during one or more unit scan periods, e.g., one or more of a first scan period T1, a second scan period T2, a third scan period T3, and a fourth scan period T4, in initialization period $T_{INIT}$.

A period before the data writing period $T_{DATA}$ may correspond to initialization period $T_{INIT}$. The initialization period $T_{INIT}$ may include a unit scan period 1H and include a period nH corresponding to multiples of a unit scan period. In one embodiment, the initialization period includes the first scan period T1, the second scan period T2, and the fourth scan period T4 that correspond to the unit scan period 1H and the third scan period T3 that is the period nH corresponding to multiples of the unit scan period 1H.

A corresponding signal may have the gate-on voltage level during all of a corresponding period. In order not to overlap a next-transferred signal, a corresponding signal may have the gate-on voltage level during only a portion of a corresponding period.

In another exemplary embodiment, the second scan signal S2 may have the gate-on voltage level during a unit scan period immediately before the data writing period $T_{DATA}$. For example, the second scan signal S2 may have the gate-on voltage level during the fourth scan period T4, which is a unit scan period immediately before the data writing period $T_{DATA}$, in the initialization period $T_{INIT}$.

In another exemplary embodiment, the second scan signal S2 may have the gate-on voltage level during two or more unit scan periods before the data writing period $T_{DATA}$. The first scan signal S1 may have the gate-on voltage level during a unit scan period between the two or more unit scan periods in which the second scan signal S2 has the gate-on voltage level. For example, the second scan signal S2 may have the gate-on voltage level during two or more unit scan periods (e.g., at least two or more of the first scan period T1, the second scan period T2, or the third scan period T3) in the initialization period $T_{INIT}$. At this time, the first scan signal S1 may have the gate-on voltage level during the second scan period T2 between the first and third scan signals S1 and S3 in which the second scan signal S2 has the gate-on voltage level.

In another exemplary embodiment, the first scan signal S1 may have the gate-on voltage level during one or more unit scan periods before the data writing period $T_{DATA}$. At this time, the second scan signal S2 may have the gate-on voltage level during a unit scan period immediately before a unit scan period in which the first scan signal S1 has the gate-on voltage level before the data writing period $T_{DATA}$, and may have the gate-on voltage level during a unit scan period immediately after a unit scan period in which the first scan signal S1 has the gate-on voltage level before the data writing period $T_{DATA}$. For example, the first scan signal S1 may have the gate-on voltage level during the second scan period T2 in the initialization period $T_{INIT}$. At this time, the second scan signal S2 may have the gate-on voltage level during the first scan period T1 or the third scan period T3, or may have the gate-on voltage level during the first scan period T1 and the third scan period T3.

During the initialization period $T_{INIT}$, the first source voltage ELVDD having a high level is applied to the drain electrode of the first transistor T1 through the second capacitor C2, and the initialization voltage is applied to the gate electrode of the first transistor T1 through the third transistor T3.

The gate-source voltage of the first transistor T1 is maintained as a difference between the first source voltage and the initialization voltage during the initialization period $T_{INIT}$. In this case, the initialization voltage has a low level.

Thus, the gate-source voltage may be equal to or higher than a minimum reference voltage that operates the first transistor T1. Therefore, in each frame, the threshold voltage "VTH" of the first transistor T1 is compensated and the first transistor T1 in each of all the pixels is in an on-bias state before the data writing period $T_{DATA}$. Therefore, the display apparatus 100 (see FIG. 1) displays an image expressed at a desired gray scale independently from hysteresis characteristic.

The first scan signal S1 has the gate-on voltage level during the data writing period $T_{DATA}$. When the second transistor T2 and the fourth transistor T4 are turned on based on the first scan signal S1 having the gate-on voltage level, the data voltage "VDATA" based on the data signal is transferred to the drain electrode of the first transistor T1 through the second transistor T2 during the data writing period $T_{DATA}$, and the first transistor T1 is diode-connected by the fourth transistor T4.

Therefore, a voltage, which is maintained at the first node N1 connected to one end of the first capacitor C1 during the data writing period $T_{DATA}$, is the gate-source voltage of the first transistor T1 and is a voltage value "VDATA-VTH" which is obtained by dropping the data voltage "VDATA" by the threshold voltage "VTH" of the first transistor T1.

Since the first transistor T1 is on-biased during the initialization period $T_{INIT}$, hysteresis characteristic is improved. Thus, a problem in which a response time is delayed in expressing a gray scale based on the data voltage "VDATA" is solved.

Subsequently, the emission control signal has the gate-on voltage level during an emission control period $T_{EM}$. When the sixth transistor T6 and the seventh transistor T7 are turned on based on the emission control signal having the gate-on voltage level, a driving current corresponding to the data voltage "VDATA" based on the data signal stored in the first capacitor C1 is transferred to the organic light-emitting diode OLED, which emits light. In this case, a voltage corresponding to the driving current is a voltage value of the difference between the first source voltage and the data voltage independent from the threshold voltage "VTH" of the first transistor T1.

Figure 4:
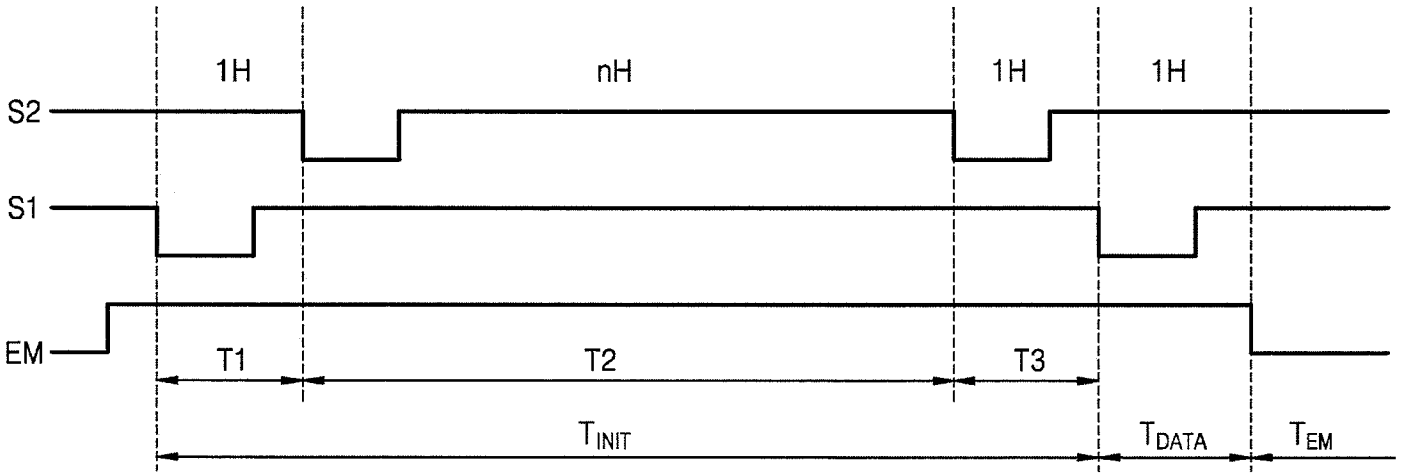
FIG. 4 illustrates another embodiment of signals for driving the pixel circuit.

FIG. 4 illustrates a timing diagram of another embodiment of a driving operation of a pixel circuit 70. Referring to FIG. 4, during the initialization period $T_{INIT}$, the pixel 70 (see FIG. 2) receives each of the first and second scan signals S1 and S2 having the gate-on voltage level at least one or more times.

The initialization period may include the first scan period T1 and the third scan period T3 that correspond to the unit scan period 1H and the second scan period T3 that is the period nH corresponding to multiples of the unit scan period 1H.

In an exemplary embodiment, the second scan signal S2 may have the gate-on voltage level during one or more unit scan periods before the data writing period $T_{DATA}$. For example, the second scan signal S2 may have the gate-on voltage level during one or more scan periods, for example, the second scan period T2 and the third scan period T3, in the initialization period $T_{INIT}$.

In an exemplary embodiment, the second scan signal S2 may have the gate-on voltage level during a unit scan period immediately before the data writing period $T_{DATA}$. For example, the second scan signal S2 may have the gate-on voltage level during the third scan period T3 that is a unit scan period immediately before the data writing period $T_{DATA}$ in the initialization period $T_{INIT}$.

In an exemplary embodiment, the first scan signal S1 may have the gate-on voltage level during a unit scan period before a unit scan period in which the second scan signal S2 has the gate-on voltage level. For example, the first scan signal S1 may have the gate-on voltage level during the first scan period T1, and the second scan signal S2 may have the gate-on voltage level during the second scan period T2 and the third scan period T3.

In another exemplary embodiment, the first scan signal S1 may have the gate-on voltage level during one or more unit scan periods before the data writing period $T_{DATA}$. At this time, the second scan signal S2 may have the gate-on voltage level during a unit scan period immediately before a unit scan period in which the first scan signal S1 has the gate-on voltage level before the data writing period $T_{DATA}$, and may have the gate-on voltage level during a unit scan period immediately after a unit scan period in which the first scan signal S1 has the gate-on voltage level before the data writing period $T_{DATA}$. For example, the first scan signal S1 may have the gate-on voltage level during the first scan period T1 in the initialization period $T_{INIT}$. At this time, the second scan signal S2 may have the gate-on voltage level during the second scan period T2 or the third scan period T3, or may have the gate-on voltage level during the second scan period T2 and the third scan period 13.

Figure 5:
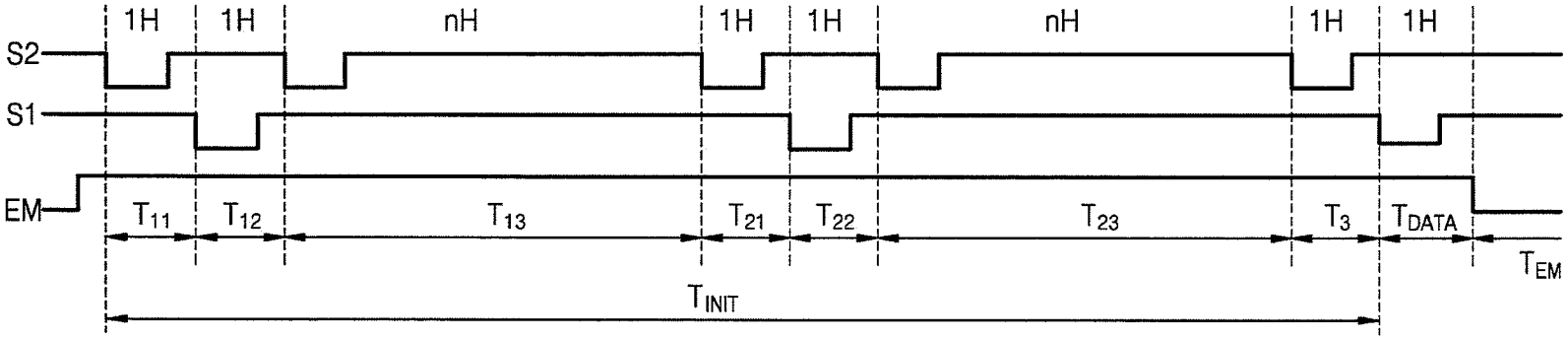
FIG. 5 illustrates another embodiment of signals for driving the pixel circuit.

FIG. 5 illustrates a timing diagram illustrates another embodiment of a driving operation of the pixel circuit 70. Referring to FIG. 5, during the initialization period $T_{INIT}$, the pixel circuit 70 (see FIG. 2) receives each of the first and second scan signals S1 and S2 having the gate-on voltage level at least one or more times.

The initialization period may include a 11th scan period T11, a 12th scan period T12, a 21st scan period T21, a 22nd scan period T22, and a third scan period T3 that correspond to the unit scan period 1H and a 13th scan period T13 and a 23rd scan period T23 that correspond to the period nH corresponding to multiples of unit scan period 1H.

In an exemplary embodiment, the second scan signal S2 may have the gate-on voltage level during one or more unit scan periods before the data writing period $T_{DATA}$. For example, the second scan signal S2 may have the gate-on voltage level during one or more unit scan periods, e.g., one or more of the 11th scan period T11, the 13th scan period T13, the 21st scan period T21, the 23rd scan period T23, and the third scan period T3, in the initialization period $T_{INIT}$.

In another exemplary embodiment, the second scan signal S2 may have the gate-on voltage level during a unit scan period immediately before the data writing period $T_{DATA}$. For example, the second scan signal S2 may have the gate-on voltage level during the third scan period T3, which is a unit scan period immediately before the data writing period $T_{DATA}$, in the initialization period $T_{INIT}$.

In another exemplary embodiment, the first scan signal S1 may have the gate-on voltage level during one or more unit scan periods before the data writing period $T_{DATA}$. At this time, the second scan signal S2 may have the gate-on voltage level during a unit scan period immediately before a unit scan period in which the first scan signal S1 has the gate-on voltage level before the data writing period $T_{DATA}$, and may have the gate-on voltage level during a unit scan period immediately after a unit scan period in which the first scan signal S1 has the gate-on voltage level before the data writing period $T_{DATA}$.

For example, the first scan signal S1 may have the gate-on voltage level during at least one of the 12th scan period T12 and the 21st scan period T21 in the initialization period $T_{INIT}$. At this time, the second scan signal S2 may have the gate-on voltage level during the 11th scan period T11 or the 13th scan period T13 or have the gate-on voltage level during the 11th scan period T11 and the 13th scan period T13. The second scan signal S2 may have the gate-on voltage level during the 21st scan period T21 or the 23rd scan period T23 or have the gate-on voltage level during the 21st scan period T21 and the 23rd scan period T23.

As described above with reference to FIGS. 3 to 5, according to exemplary embodiments, since a time (e.g., the initialization period $T_{INIT}$) for which a driving transistor is on-biased increases, the hysteresis characteristic of the driving transistor is improved. Also, according to one or more embodiments, since the driving transistor maintains an on-bias state by alternately using the first scan signal S1 and the second scan signal S2, smear is reduced or prevented from occurring in a panel, or excessive consumption of power resulting from continuously driving the scan driver is reduced or prevented.

Figure 6:
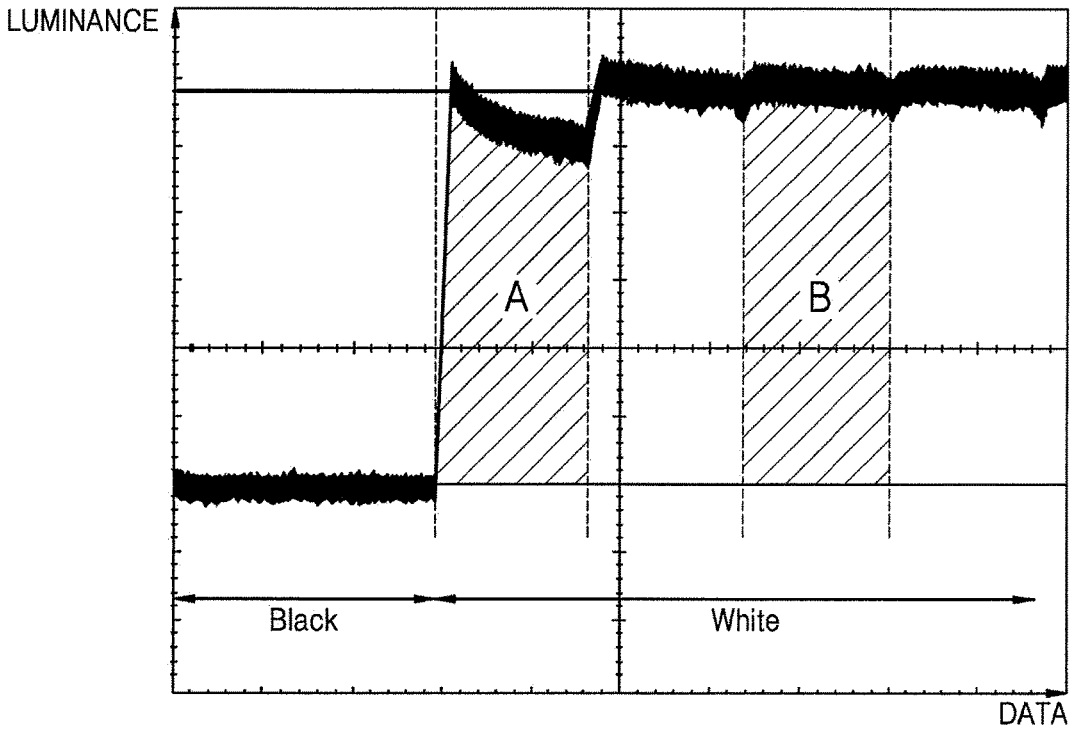
FIG. 6 illustrates an example of response time for a display apparatus.

FIG. 6 is a waveform diagram illustrating an example a response time of an display apparatus. Referring to FIG. 6, in expressing a gray scale in a pixel, a response time is delayed due to hysteresis. For example, when a pixel which displays black luminance for a long time according to a black data signal "Black" receives a white data signal "White," light is not emitted at a target value of luminance based on the white data signal "White." A pixel emits light having a target value of luminance from a time when at least one frame elapses from a time when a data signal is transferred. The response time may denote a percentage of A to B.

In the initialization period $T_{INIT}$ described above with reference to FIGS. 3 to 5, a case in which a scan signal having the gate-on voltage level is received during one or more unit scan periods before the data writing period $T_{DATA}$ has a faster response time than a case in which the scan signal having the gate-on voltage level is received during only a unit scan period immediately before the data writing period $T_{DATA}$. Thus, hysteresis of a pixel may be improved by extending the initialization period.

In accordance with another embodiment, an apparatus includes one or more outputs and a controller to output one or more signals through the one or more outputs to control a display. The one or more signals may control, for example, one or more drivers to initialize one or more characteristics of a driving transistor of a pixel, to compensate for the threshold voltage of the driving transistor, to transfer a data signal to the driving transistor, and to emit light from an OLED of the pixel based on driving current corresponding to the data signal. Initializing the one or more characteristics of the driving transistor includes transferring a first scan signal having a gate-on voltage level at least one time, and transferring a second scan signal having the gate-on voltage level at least one time.

The controller may correspond, for example, to the timing controller in accordance with the aforementioned embodiments, or the controller may be a controller different from the timing controller. In one embodiment, the controller may include the timing controller and one or more of the drivers shown in FIG. 1, or may include the timing controller without the drivers.

The first scan signal may have the gate-on voltage level during a unit scan period before a unit scan period in which the second scan signal has the gate-on voltage level. The first scan signal may have the gate-on voltage level during a unit scan period between two or more unit scan periods in which the second scan signal has the gate-on voltage level. The second scan signal may have the gate-on voltage level during two or more unit scan periods, and a period between two or more unit scan periods in which the second scan signal may have the gate-on voltage level is multiples of a unit scan period In this embodiment, the one or more outputs may take various forms. For example, when the controller is embodied within an integrated circuit chip, the one or more outputs may be one or more output terminals, leads, wires, ports, signal lines, and/or other type of interface without or coupled to the controller.

The controllers and other processing features of the embodiments described herein may be implemented in logic, which, for example, may include hardware, software, or both. When implemented at least partially in hardware, the controllers and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display apparatus, comprising:

a display unit including a plurality of pixels connected to a plurality of scan lines, a plurality of data lines, and a plurality of emission control lines, wherein each of the pixels includes:

an organic light-emitting diode (OLED);

a first transistor to transfer driving current, based on a data signal, to the OLED;

a second transistor to transfer the data signal to the first transistor based on a first scan signal having a gate-on voltage level during a data writing period;

a compensation transistor to diode-connect the first transistor based on the first scan signal having the gate-on voltage level during the data writing period;

a first capacitor connected between a gate electrode of the first transistor and a first power source; and a second capacitor connected between a drain electrode of the first transistor and the first power source, wherein the first transistor is on-biased during an initialization period, wherein the first scan signal has the gate-on voltage level during a unit scan period before a unit scan period in which a second scan signal has the gate-on voltage level.

2. The display apparatus as claimed in claim 1, wherein:

the gate electrode of the first transistor is connected to a first node, and the second transistor is connected to the first node through the first transistor.

3. The display apparatus as claimed in claim 1, wherein each of the pixels includes a third transistor to supply an initialization voltage to the gate electrode of the first transistor, in order to initialize a characteristic of the first transistor based on the second scan signal having the gate-on voltage level during the initialization period.

4. The display apparatus as claimed in claim 3, wherein the second scan signal has the gate-on voltage level during a unit scan period immediately before the data writing period.

5. The display apparatus as claimed in claim 3, wherein the second scan signal has the gate-on voltage level during one or more unit scan periods before the data writing period.

6. The display apparatus as claimed in claim 3, wherein:

the second scan signal has the gate-on voltage level during two or more unit scan periods before the data writing period, and the first scan signal has the gate-on voltage level during a unit scan period between two or more unit scan periods in which the second scan signal has the gate-on voltage level.

7. The display apparatus as claimed in claim 3, wherein:

the second scan signal has the gate-on voltage level during two or more unit scan periods before the data writing period, and a period between two or more unit scan periods in which the second scan signal has the gate-on voltage level is multiples of a unit scan period.

8. The display apparatus as claimed in claim 3, wherein:

the first scan signal has the gate-on voltage level during one or more unit scan periods before the data writing period, and the second scan signal has the gate-on voltage level during a unit scan period immediately before a unit scan period in which the first scan signal has the gate-on voltage level before the data writing period and/or a unit scan period immediately after a unit scan period in which the first scan signal has the gate-on voltage level.

9. The display apparatus as claimed in claim 3, wherein the initialization period is prior to the data writing period.

10. The display apparatus as claimed in claim 1, wherein each of the pixels includes a transistor to supply the initialization voltage to an anode electrode of the OLED based on a third scan signal.

11. The display apparatus as claimed in claim 10, wherein the third scan signal is equal to the first scan signal.

12. The display apparatus as claimed in claim 1, wherein each of the pixels includes a transistor to turn on based on an emission control signal and a transistor connected to the second capacitor in parallel.

13. The display apparatus as claimed in claim 1, wherein each of the pixels includes a transistor to connect the first transistor to the OLED based on an emission control signal.

14. The display apparatus as claimed in claim 1, further comprising:

a scan driver to transfer scan signals through the scan lines;

a data driver to transfer data signals through the data lines; and an emission driver to transfer emission control signals through the emission control lines.

15. A method for driving a display apparatus, the method comprising:

initializing a characteristic of a driving transistor and setting the driving transistor in an on-biased state during an initialization period;

compensating for a threshold voltage of the driving transistor and transferring a data signal to the driving transistor based on a first scan signal; and emitting light from the OLED based on driving current corresponding to the data signal, wherein initializing the characteristic includes:

transferring the first scan signal having a gate-on voltage level at least one time; and transferring a second scan signal having the gate-on voltage level at least one time, wherein the first scan signal has the gate-on voltage level during a unit scan period before a unit scan period in which the second scan signal has the gate-on voltage level.

16. The method as claimed in claim 15, wherein the first scan signal has the gate-on voltage level during a unit scan period between two or more unit scan periods in which the second scan signal has the gate-on voltage level.

17. The method as claimed in claim 15, wherein:

the second scan signal has the gate-on voltage level during two or more unit scan periods, and a period between two or more unit scan periods in which the second scan signal has the gate-on voltage level is multiples of a unit scan period.

* * * * *